US007289092B2

(12) United States Patent
Shimizu et al.

(10) Patent No.: US 7,289,092 B2
(45) Date of Patent: Oct. 30, 2007

(54) LIQUID-CRYSTAL DRIVER AND LIQUID-CRYSTAL DISPLAY

(75) Inventors: Yukihiro Shimizu, Nara (JP); Tomoaki Nakao, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 706 days.

(21) Appl. No.: 10/845,317

(22) Filed: May 14, 2004

(65) Prior Publication Data

US 2004/0227775 A1 Nov. 18, 2004

(30) Foreign Application Priority Data

May 14, 2003 (JP) ..... 2003-135220

(51) Int. Cl.
*G09G 3/36* (2006.01)

(52) U.S. Cl. ..... 345/89

(58) Field of Classification Search ..... 345/87, 345/89, 98, 99, 100, 88, 90–97, 690, 204–215
See application file for complete search history.

(56) References Cited

U.S. PATENT DOCUMENTS 7,006,114 B2 * 2/2006 Sakaguchi ..... 345/690
2002/0186231 A1 * 12/2002 Kudo et al. ..... 345/690
2003/0137526 A1 * 7/2003 Sakaguchi ..... 345/690

FOREIGN PATENT DOCUMENTS

JP 2837027 10/1998

* cited by examiner

*Primary Examiner*—Vu Le
*Assistant Examiner*—Richard Clemon
(74) *Attorney, Agent, or Firm*—Harness, Dickey & Pierce, PLC

(57) ABSTRACT

Reference voltage generation means is constituted by including first voltage division means constituted so as to be able to generate a plurality of levels of gradation display voltages by resistance-dividing voltage differences between a plurality of reference voltages VR by a plurality of dividing resistors connected in series, second voltage division means constituted so as to be able to generate some or all of the gradation display voltages by resistance-dividing voltage differences between a plurality of reference voltages VR by a plurality of auxiliary resistors connected in series, and switching means for mutually connecting all or a part of the plurality of gradation display voltages generated by the first voltage division means and the second voltage division means. The switching means is turned on during the transient state period in which the DA conversion circuit responds and the first and second voltage division means operate.

18 Claims, 19 Drawing Sheets

LIQUID-CRYSTAL DRIVER AND LIQUID-CRYSTAL DISPLAY

BACKGROUND OF THE INVENTION

1. Field of the Invention

The present invention relates to an active-matrix liquid-crystal display and its liquid-crystal driver, particularly to a technique to be effectively applied to a reference voltage generation circuit for generating a gradation display voltage.

2. Description of the Related Art

For example, the specification of U.S. Pat. No. 2,837,027 discloses a conventional liquid-crystal display. FIGS. 11 to 13 show a relation of the connection of an input/output signal between driver ICs of the conventional liquid-crystal display. In general, the connection between driver ICs is performed through a printed wiring board as shown in, for example, FIG. 13.

FIG. 11 shows a state in which a conventional driver IC (liquid-crystal driver) is mounted on a TCP (Tape Carrier Package). An input/output signal is connected between driver ICs by setting an input/output external connection terminal portion 51 common to a plurality of driver ICs to the downside (opposite side to external connection terminal portion 55 for liquid-crystal driving output) of the TCP and as shown in FIG. 13, connecting the terminal portion 51 with a lead terminal for connection of printed wiring boards 71, 72, and 75 by solder.

A driver chip 57 is set to almost the center of the TCP and the external connection terminal portion 55 for liquid-crystal driving output is set to the upside and the input/output external connection terminal portion 51 (common to the plurality of driver ICs) is set to the downside to lead terminals S1 to S7 to the outside. The chip portion is covered with a resin and thereby electrically and physically protected. Moreover, the external connection terminal portion 55 for liquid-crystal driving output is generally directly connected to a liquid-crystal panel through an anisotropic conductive sheet. Because a slit from which a TCP base material is extracted is formed on the input/output external connection terminal portion 51, it is possible to supply a signal common to the plurality of driver ICs by solder-connecting the portion 51 to the printed wiring board.

FIG. 12 is an enlarged view of the connective portion between the chip 57 and the TCP. A pad 67 set on the chip and an inner lead 64 set to the central portion of the TCP are electrically and physically connected each other by thermally contact-bonding them. In this case, the terminals S1 to S7 of the input/output-signal terminal portion 51 are used for signals one each and as a matter of course, pads are used for the signals one each.

FIG. 13 is an illustration showing a mounted conformation of a conventional liquid-crystal module. When assuming a panel of 640 (lateral direction)×400 (longitudinal direction) dots, eight segment drivers vertically arranged have 160 liquid-crystal driving outputs and four common drivers arranged at the left side have 100 liquid-crystal driving outputs.

Moreover, the above specification of U.S. Pat. No. 2,837,027 discloses a method for constituting the liquid-crystal display by only the liquid-crystal panel and TCP without using the above printed wiring board. FIG. 14 shows a state in which driver ICs of the liquid-crystal display are mounted on the TCP. External connection terminal portions for the same input/output signals (S1 to S7) 11 and 12 are arranged at the right and left of the TCP and a slit 13 from which the TCP base material is removed is formed on the external connection terminal portion at one side (left side 11 for this embodiment) and a lead 14 which can be solder-connected is formed on the external connection terminal at the opposite side (right side 12 for this embodiment). Thereby, a configuration is shown in which adjacent ICs are directly connected each other without through the printed wiring board.

FIG. 15 is an enlarged view of the connective portion between a chip 17 and the TCP in the driver IC. The chip 17 is set to a hole portion 20 in FIG. 14. FIG. 15 is greatly different from FIG. 12 in that a pad 27 for the same signals (S1 to S7) is set to the right and left in the chip and the pads 27 for the same signals at the right and left of the chip 17 are connected each other by a wiring material 21 in the chip at a comparatively low impedance. The wiring material 21 is constituted by a conductor such as a second-layer metal on the chip or a gold bump (formed on pad portion of TCP product) on the chip.

A pad 28 for a liquid-crystal driving-output signal 23 is formed on the upper portion of the chip 17. No pad is basically set on the lower portion of the chip 17. However, a dummy pad may be set in order to protect the connection strength between the chip and TCP.

FIG. 16 shows a specific connection procedure between ICs of the driver ICs. The external connection terminal at the slit-13*b* side of a TCP 40*b* is set to the upper side and the external connection terminal at the connection lead-14*a* side of an adjacent IC 17*a* (40*a*) is set to the lower side, they are aligned, and leads of the both external connection terminals are overlapped and connected by solder.

FIG. 17 shows a formed liquid-crystal module and a connection between the liquid-crystal and the TCP. A dot configuration (640×400) completely the same as that in FIG. 13 is imaged, in which eight segment drivers using a printed wiring board at upper and lower portions of a panel (four upper drivers and four lower drivers) and four common drivers are used at the left of the panel. Also in this case, a segment driver has 160 liquid-crystal driving outputs and a common driver has 100 liquid-crystal driving outputs.

Devices of eight segment drivers and four common drivers are mutually solder-connected by connection leads 31, 32, and 35 formed at an adjacent overlapped TCP portion. That is, six portions (three upper portions and three lower portions) are mutually solder-connected between the segment drivers and three portions are mutually solder-connected between the common drivers. Moreover, it is possible to connect the common drivers with the segment drivers by the same method.

An example relating to the drain driving circuit of a TFT liquid-crystal display capable of displaying multicolor of 64 gradations in the above driver IC is described in "Low-Power 6-bit Column Driver for AMLCDs", issued in June, 1994, SID 94 DIJEST pp. 351-354.

The drain driving circuit has one-gradation-voltage generation circuit and generates gradation voltages of 64 gradations in accordance with gradation reference voltages (V0-V8) of nine values input from a not-shown internal power supply circuit.

The drain driving circuit captures 6-bit display data values for red, green, and blue by the number of outputs synchronously with a display-data-latching clock signal and moreover, selects gradation voltages corresponding to the display data values out of gradation voltages of 64 gradations generated by the gradation voltage generation circuit in accordance with an output-timing-control clock signal, and outputs the selected gradation voltages to drain signal lines.

Moreover, to prevent the liquid-crystal layer serving as a pixel from deteriorating, the polarity of an output voltage (voltage to be applied to pixel electrode) of the drain driving circuit and the polarity of a voltage to be applied to a not-shown common electrode are reversed on each AC cycle of a DC to AC signal (not shown).

FIG. 18 is a circuit diagram showing a schematic configuration of the gradation voltage generation circuit of the drain driving circuit of the liquid-crystal display.

As shown in FIG. 18, a gradation voltage generation circuit 606 of the drain driving circuit of the liquid-crystal display first generates gradation voltages of 8×8=64 (gradations) by dividing gradation reference voltages of nine values (V0 to V8) input from the internal power-supply circuit into 8 voltages by the DC resistance division circuit 605.

Then, the circuit 606 selects gradation voltages corresponding to the display data values by a selection circuit 113 constituted by 64×b MOS transistors and outputs the voltages to drain signal lines 1 to b.

FIG. 19 is a circuit diagram showing a schematic configuration for one-gradation reference voltage constituted by a gradation reference voltage Vn and a gradation reference voltage Vn−1 (n=1−8) in the gradation voltage generation circuit 606 shown in FIG. 18, which is constituted by the DC resistance division circuit 605 and a circuit for one-gradation reference voltage of the selection circuit 113.

As shown in FIG. 19, the conventional DC resistance division circuit 605 is constituted by dividing resistors 105 to 112 for dividing the gradation reference voltages Vn and Vn−1 (n=1−8) input from the internal power-supply circuit into eight voltages and has a resistance value R.

Recently, however, there is a trend of decreasing the width (picture frame size) of a portion protruded from the glass substrate of the liquid-crystal panel and securing a larger display area at the same module size. Moreover, because the liquid-crystal panel is still high in cost compared to a CRT, a cost-cutting request is very severe.

Under the above situation, to decrease the width of the TCP protruded from a glass substrate, as shown in FIG. 17, a configuration is used in which the liquid-crystal display is constituted by only the liquid-crystal panel and TCP without using a printed wiring board and a signal line is connected between adjacent TCPs to send or receive an input signal by using only a wiring on the TCP or also locally using a wiring on the glass substrate.

However, in the case of a configuration for sending or receiving an input signal by using only a wiring on the TCP or also locally using a wiring on a glass substrate, the followings become problems: increase of the number of input signals or reference power-supply terminals, increase of cost due to increase of the number of input signals or reference power-supply terminals, and wiring resistance of a reference power supply. Particularly, as the liquid-crystal panel increases in size, a wiring resistance is increased due to extension of wirings in various directions and potentials of a reference power supply and the like may be changed between drivers for driving the liquid-crystal panel due to a voltage drop on a wiring. As a result, a display trouble (block separation) or the like may occur.

It is also considered to increase a wiring in diameter by considering increase of the wiring resistance. For example, however, when increasing the diameter of a lead wiring on the TCP or a wiring on the glass substrate, the size of the TCP increases or it is necessary to increase the driver mounting area on the glass substrate. Therefore, the number of panels to be taken from mother glass may decrease or the cost may increase.

In the case of the single drain driving circuit disclosed in FIG. 18, by dividing gradation reference voltages (V0 to V8) of nine values input from an internal power-supply circuit (not illustrated) into eight voltages by the DC resistance division circuit 605, gradation voltages of 8×8=64 (gradations) are generated and the selection circuit 113 is constituted so as to select any one of gradation voltages corresponding to display data by the DA conversion circuit constituted by 64×b MOS transistors and output the selected voltage.

As the liquid-crystal panel increases in size, a drain driving circuit also tends to be increased in the number of outputs. However, when the number of output loads increases, it is necessary to secure a response speed by decreasing the resistance value of the DC resistance division circuit 605 and supplying a more current. In this case, when the number of source signal lines for outputting the same gradation voltage increases in one drain driving circuit, the voltage fluctuation of a gradation reference voltage generation circuit increases. Particularly, brightness unevenness may occur at an intermediate-gradation display portion in which a change of transmittances of the liquid-crystal layer to an applied voltage is large on a display screen.

SUMMARY OF THE INVENTION

The present invention is made to solve the above problems and its object is to provide the liquid-crystal driver and the liquid-crystal display respectively consuming only a small power and capable of restraining a display trouble such as brightness unevenness.

A liquid-crystal driver of the present invention for achieving the above object comprises reference voltage generation means for generating $2^n$ levels of gradation display voltages corresponding to n-bit display data in accordance with a plurality of input reference voltages and the DA conversion circuit for selecting gradation display voltages corresponding to the above input display data out of $2^n$ levels of gradation display voltages, which is constituted so as to be able to output the selected gradation display voltages to the liquid-crystal panel through a plurality of output terminals. The reference voltage generation means has first voltage division means constituted so as to be able to generate $2^n$ levels of gradation display voltages by resistance-dividing voltage differences between the reference voltages by a plurality of dividing resistors connected in series, second voltage division means constituted so as to be able to generate some or all of $2^n$ levels of the gradation display voltages by resistance-dividing voltage differences between the reference voltages by a plurality of auxiliary resistors connected in series, and switching means for mutually connecting $2^n$ levels of the gradation display voltages generated by the first voltage division means with some or all of $2^n$ levels of the corresponding gradation display voltages generated by the second voltage division means so that the switching means is turned on during the transient state period when the DA conversion circuit responds and the first voltage division means and the second division means operate.

Moreover, in the case of the liquid-crystal driver of the present invention having the above configuration, the combined resistance of the dividing resistors connected in series of the first voltage division means is higher than the combined resistance of the auxiliary resistors connected in series of the second voltage division means and the reference voltage generation means outputs at least the maximum voltage and minimum voltage of the input reference voltages through a low-output-impedance voltage follower circuit.

DETAILED DESCRIPTION OF THE INVENTION (PREFERRED EMBODIMENTS)

The liquid-crystal driver of the present invention (hereafter properly referred to as "present invention device") and the liquid-crystal display of the present invention having the present invention drive are described below by referring to the accompanying drawings.

First Embodiment

Figure 1:
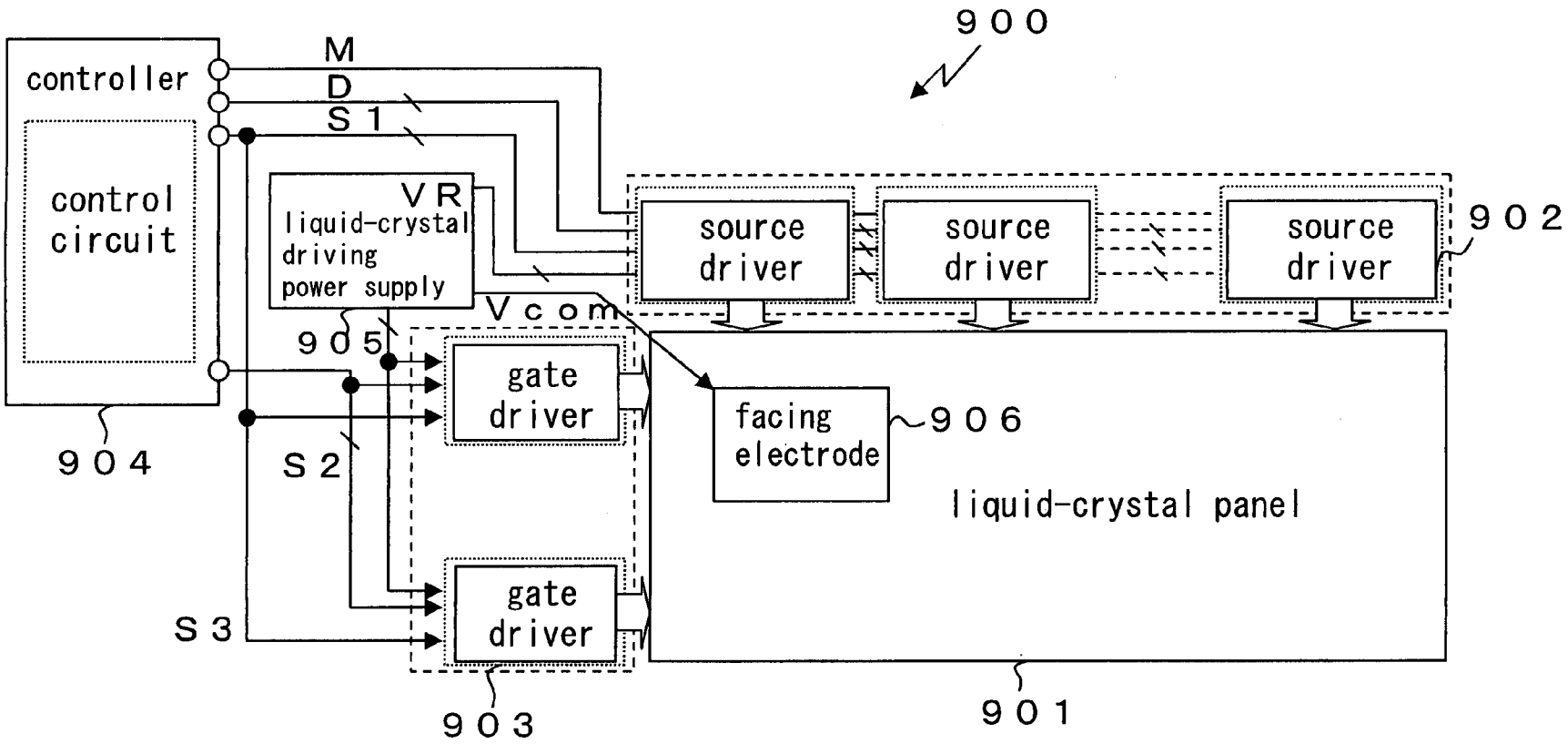
FIG. 1 is a block diagram showing an embodiment of the liquid-crystal display of the present invention having the liquid-crystal driver of the present invention.

FIG. 1 shows a block diagram of the TFT (Thin Film Transistor)-type liquid-crystal display 900 which is a typical example of active matrix systems.

The liquid-crystal display 900 is constituted by the liquid-crystal display portion and the liquid-crystal driving portion for driving the liquid-crystal display. The liquid-crystal display portion has the TFT-type liquid-crystal panel 901. A not-shown liquid-crystal display device and a facing electrode (common electrode) 906 are set in the liquid-crystal panel 901.

The above liquid-crystal driving portion is constituted by including a source driver 902 and a gate driver 903 which are respectively constituted by an IC (Integrated Circuit) chip, a controller 904, and a liquid-crystal driving power supply 905.

In general, the source driver 902 or gate driver 903 is constituted by mounting the IC chip of the source driver 902 or gate driver 903 on a film having a wiring such as the TCP (Tape Carrier Package) and mounting the TCP on an ITO (Indium Tin Oxide) film for connection or directly thermally contact-bonding the IC chip the ITO terminal of the liquid-crystal panel through an ACF (Anisotropic Conductive Film).

The controller 904 outputs digitized display data D values (e.g. R, G, and B signals corresponding to read, green, and blue) and various control signals to the source driver 902 and various control signals to the gate driver 903. Main control signals to be output to the source driver 902 include a horizontal sync signal, start pulse signal, and clock signal for the source driver, which are shown by S1 in FIG. 1. However, main signals to be output to the gate drive 903 include a vertical sync signal and a clock signal for a gate driver, which are shown by S2 in FIG. 1. In FIG. 1, a power supply for driving each IC is not illustrated.

The liquid-crystal driving power supply 905 supplies the liquid-crystal panel display voltage (e.g. reference voltage for generating gradation display voltage as voltage relating to the present invention) to the source driver 902 and gate driver 903.

The display data input from an external unit is supplied to the source driver 902 as the display data D digitized through the controller 904. In this case, a configuration is used in which the liquid-crystal display is constituted only by the liquid-crystal panel and the TCP without using the printed wiring board described for the prior art, a signal wiring is connected between adjacent TCPs, and input signals are sending and receiving to and from each source driver 902 by using only a wiring on the TCP or also locally using a wiring on a glass substrate.

The source driver 902 latches the input digitized data D inside by means of time sharing and then, performs DA (digital-to-analog) conversion synchronously with a horizontal sync signal also referred to as latch signal LS (See FIG. 5) input from the controller 904. Then, the source driver 902 outputs a gradation-display analog voltage (gradation display voltage) obtained through the DA conversion from the liquid-crystal driving-voltage output terminal to the liquid-crystal display device (not shown) in the liquid-crystal panel 901 corresponding to the liquid-crystal driving-voltage output terminal through a source signal line 1004 to be described later (See FIG. 2).

Figure 2:
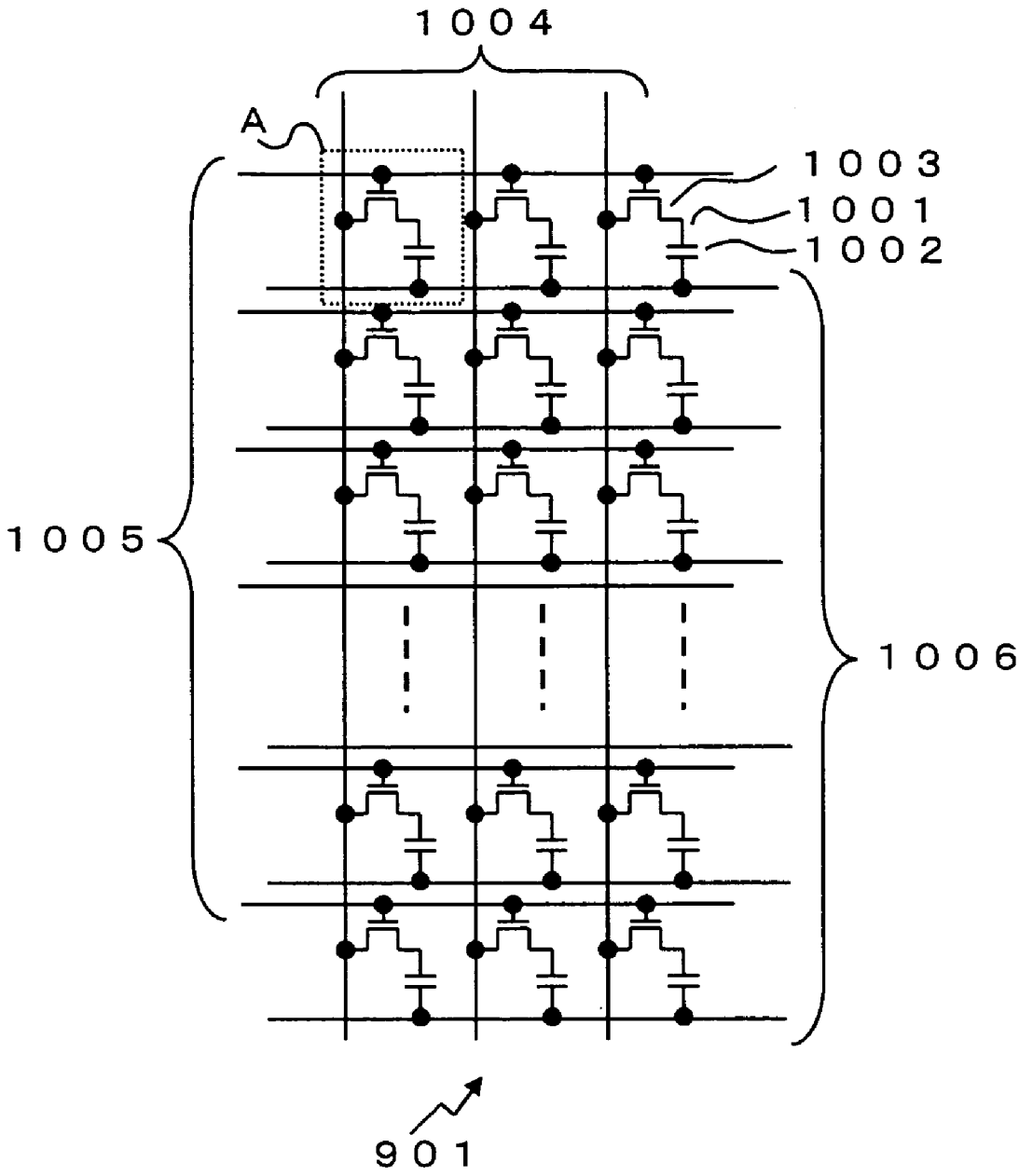
FIG. 2 is an illustration showing a general configuration of the liquid-crystal panel.

Then, the liquid-crystal panel 901 is described below. FIG. 2 shows a configuration of the liquid-crystal panel 901. The liquid-crystal panel 901 has a pixel electrode 1001, pixel capacitor 1002, TFT (Thin Film Transistor) 1003 serving as a device for turning on/off application of a voltage to a pixel, source signal line 1004, gate signal line 1005, and facing electrode 1006 of the liquid-crystal panel (corresponding to facing electrode 906 in FIG. 1). In FIG. 2, the region shown by A denotes the liquid-crystal display device for one pixel.

A gradation display voltage corresponding to the brightness of a pixel to be displayed is supplied to the source signal line 1004 from the source driver 902. A scanning signal is supplied to the gate signal line 1005 from the gate driver 903 so that TFTs 1003 arranged in the longitudinal direction are sequentially turned on. When the voltage of the source signal line 1004 is applied to the pixel electrode 1001 connected to the drain of a turned-on TFT 1003 through the TFT, electric charges are accumulated in the pixel capacitor 1002 between the pixel electrode 1001 and the facing electrode 1006, light transmittances of liquid crystal are changed, and displaying is performed.

Figure 3:
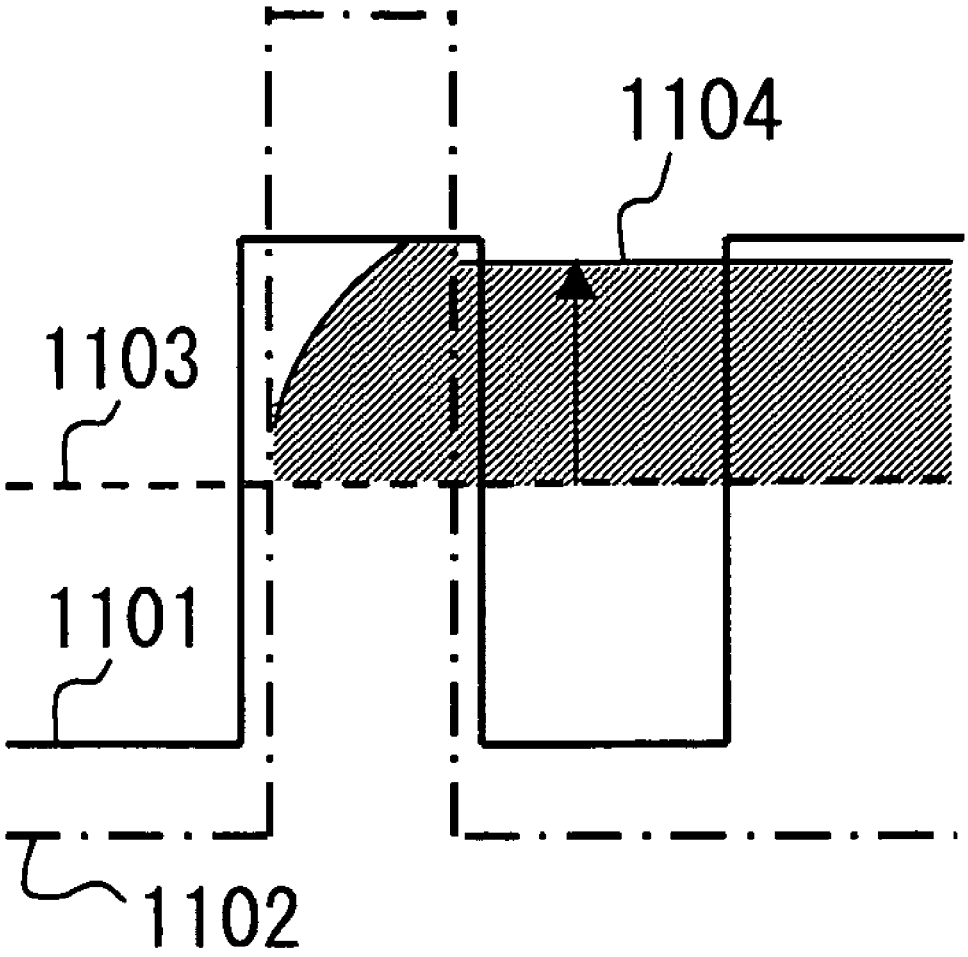
FIG. 3 is a waveform diagram showing an example of liquid-crystal driving waveforms.
Figure 4:
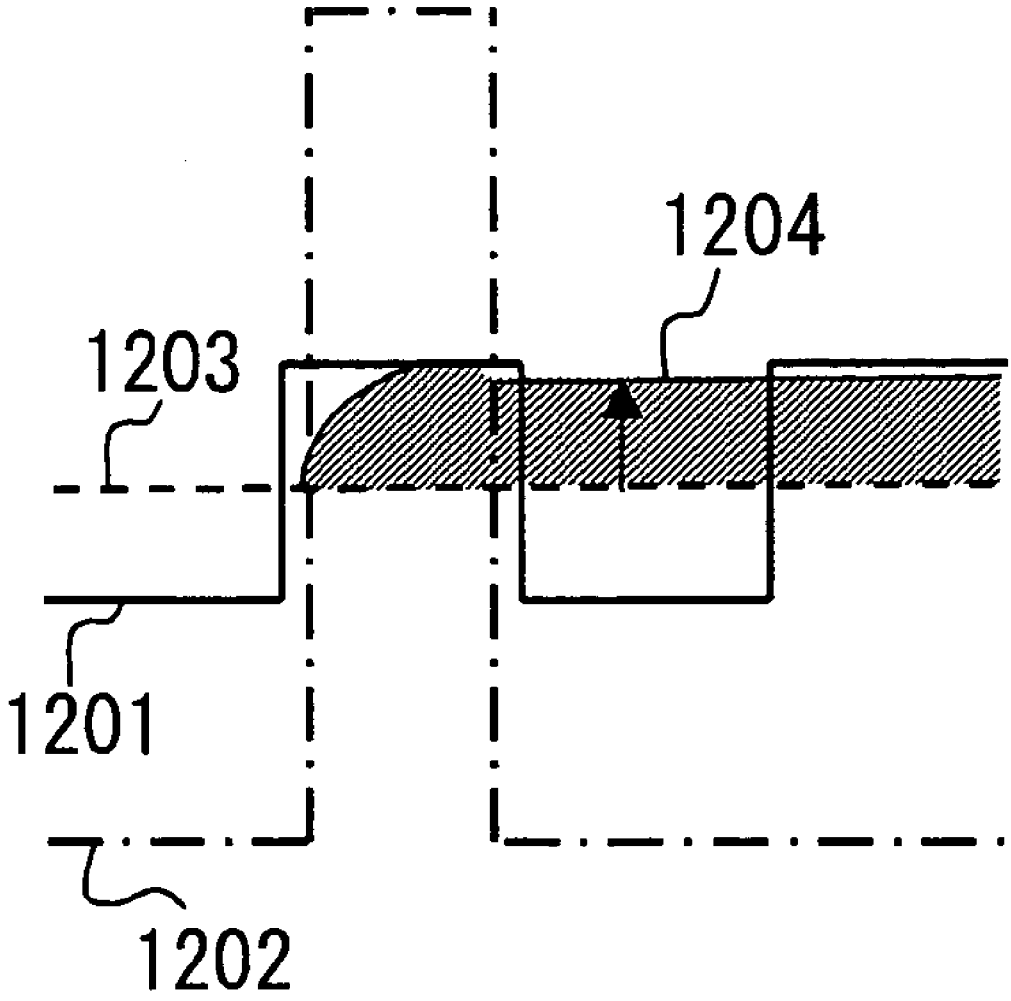
FIG. 4 is a waveform diagram showing another example of liquid-crystal driving waveforms.

FIGS. 3 and 4 respectively show an example of liquid-crystal driving waveforms. In FIGS. 3 and 4, a waveform designated by symbols 1101 and 1201 are driving waveforms of signals output from the source driver 902 and waveforms designated by symbols 1102 and 1202 are driving waveforms of signals output from the gate driver 903. Potentials designated by symbols 1103 and 1203 are potentials of the facing electrode 1006 and waveforms designated by symbols 1104 and 1204 are voltage waveforms of the pixel electrode 1001. A voltage to be applied to the liquid-crystal material is a potential difference between the pixel electrode 1001 and facing electrode 1006, which is hatched in FIGS. 3 and 4.

For example, in FIG. 3, when a signal output from the gate driver 903 shown by the driving waveform 1102 is kept high-level, the TFT 1003 is turned on and the difference between the signal output from the source driver 902 shown by the driving waveform 1101 and the potential 1103 of the facing electrode 1006 is applied to the pixel electrode 1001. Thereafter, as shown by the driving waveform 1102, the signal output from the gate driver 903 becomes low-level and the TFT 1003 is turned off. In this case, the pixel is kept at the above voltage because the pixel capacitor 1002 is present. The same is also applied to the case in FIG. 4.

FIGS. 3 and 4 show cases in which voltages to be applied to the liquid-crystal material are different from each other. In the case of FIG. 4, an applied voltage is lower than the case in FIG. 3. Thus, by changing voltages to be applied to liquid crystal as analog voltages, light transmittances of liquid crystal are analogically changed to realize gradation displaying. The number of gradations which can be displayed is decided by the number of analog-voltage options to be applied to liquid crystal.

Because the present invention relates to a reference voltage generation circuit in a gradation display circuit occupying a particularly large circuit scale and power consumption, a present-invention device is hereafter described mainly on the source driver 902.

Figure 5:
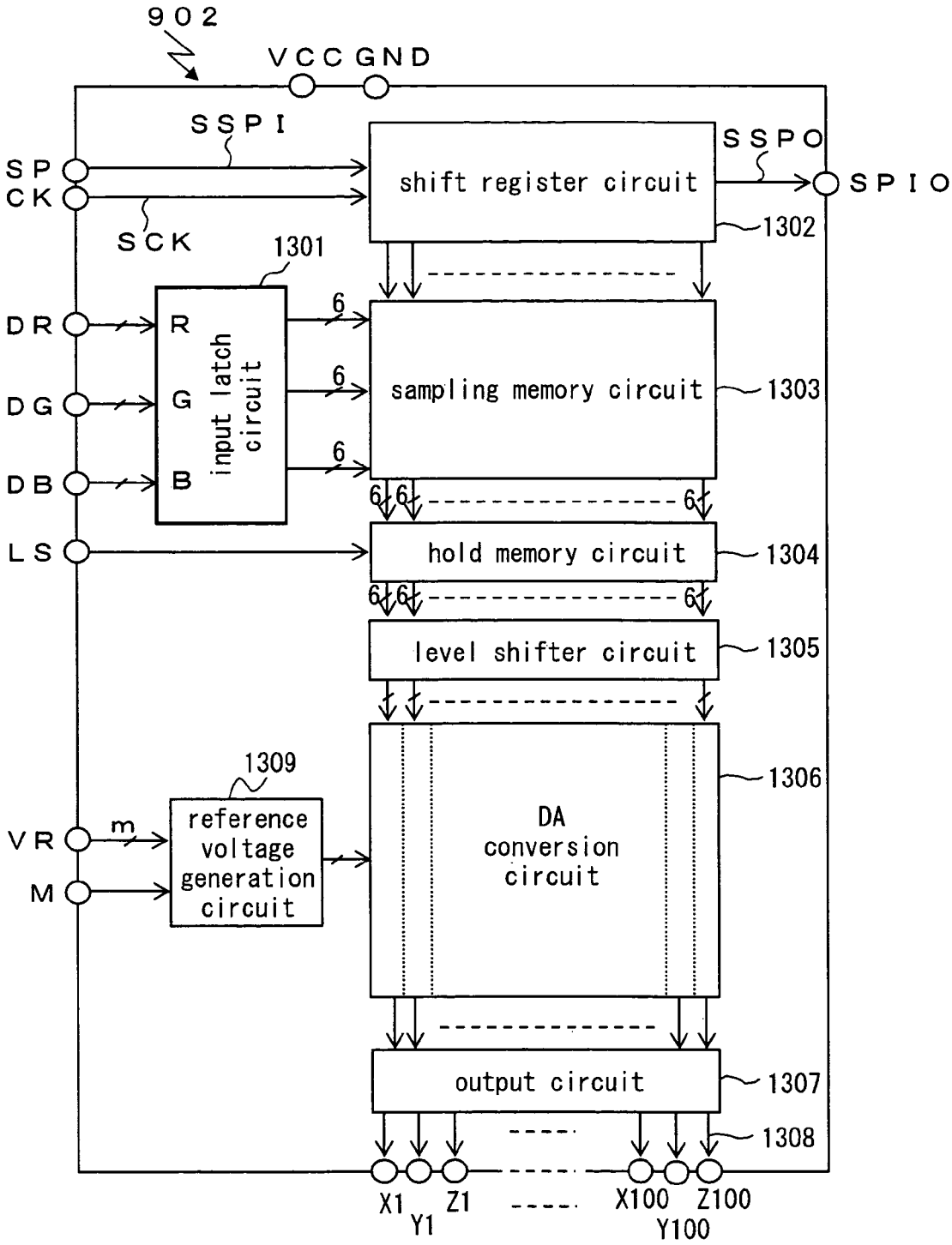
FIG. 5 is a block diagram showing a configuration of a source driver which is an example of liquid-crystal drivers of the present invention.

FIG. 5 shows a block diagram of the source driver 902 which is an example of a present-invention device. Only basic portions are described below.

Digitized data values DR, DG, and DB (for example, 6 bits each) transferred from the controller 904 are temporarily latched by an input latch circuit 1301. The digitized data values DR, DG, and DB correspond to red, green, and blue respectively.

A start pulse signal SP is synchronized with a clock signal CK, transferred through a shift register circuit 1302, and output from the final stage of the shift register circuit 1302 to the next-stage source driver as the start pulse signal SP (cascade output signal SSPO).

The digitized data values DR, DG, and DB latched by the above input latch circuit 1301 synchronously with a signal output from each stage of the shift register circuit 1302 are temporarily stored in a sampling memory circuit 1303 by means of time shearing and then output to the next hold memory circuit 1304.

When one-horizontal-sync-period display data is stored in the sampling memory circuit 1303, the hold memory circuit 1304 captures a signal output from the sampling memory circuit 1303 in accordance with a horizontal-sync signal (latch signal LS) and outputs the signal to the next level shifter circuit 1305 and keeps the display data until the next horizontal-sync signal is input.

The level shifter circuit 1305 is a circuit for converting a signal level through boosting so as to be adapted to the DA conversion circuit 1306 at the next stage for processing the level of a voltage to be applied to the liquid-crystal panel. A reference voltage generation circuit 1309 generates various analog voltages for displaying gradations in accordance with the reference voltage VR supplied from the above-described liquid-crystal driving power supply 905 (See FIG. 1) and outputs the voltages to the DA conversion circuit 1306.

The DA conversion circuit 1306 selects an analog voltage corresponding to the display data level converted by the level shifter circuit 1305 out of various analog voltages supplied from the reference voltage generation circuit 1309. The analog voltage showing a gradation is output to each source signal line of the liquid-crystal panel 901 from each liquid-crystal driving voltage output terminal (hereafter merely described as output terminal) 1308 through an output circuit 1307. The output circuit 1307 is basically a buffer circuit which is constituted by a voltage follower circuit using, for example, a differential amplifying circuit.

Then, a circuit configuration of the reference voltage generation circuit 1309 constituting a characteristic portion of a present-invention device is more minutely described below.

Figure 6:
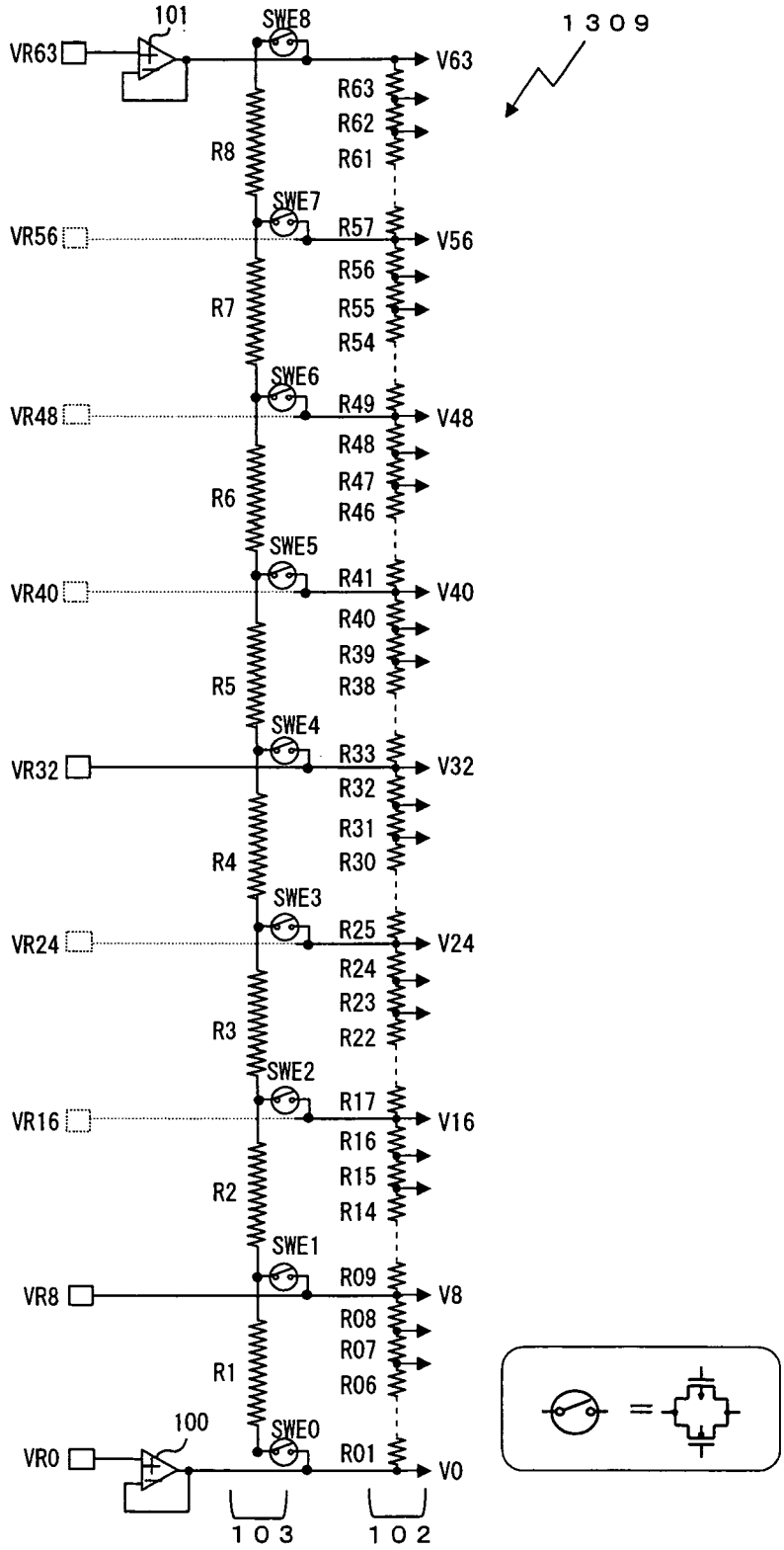
FIG. 6 is a circuit diagram showing a circuit configuration of a reference voltage generation circuit of a first embodiment of the liquid-crystal driver of the present invention.

FIG. 6 shows a circuit configuration of the reference voltage generation circuit 1309 of the present-invention device of the first embodiment. When digitized data values corresponding to R, G, and B are respectively constituted by, for example, 6 bits, the reference voltage generation circuit 1309 outputs 64 levels of analog voltages V0 to V63 corresponding to $2^6=64$ levels of gradation displays out of m levels of reference voltages VRi (m values selected out of i=0–63, which are merely shown as VR in FIG. 5). A specific configuration of the above described is described below.

The reference voltage generation circuit 1309 of the embodiment of the present invention is constituted by including first voltage division means 102 in which dividing resistors R01 to R63 are connected in series and which has a comparatively-high combined resistance value of the dividing resistors, second voltage division means 103 in which auxiliary resistors R1 to R8 are connected in series and which has a comparatively-low combined resistance value of the auxiliary resistors compared with the first voltage division means 102, and switching means SWE0 to SWE8 for connecting the dividing resistors R01 to R63 with the auxiliary resistors R1 to R8. The analog switches SWE0 to SWE8 serving as the switching means are respectively constituted by a MOS transistor and a transmission gate and turned on/off in accordance with the signal M shown in FIG. 5.

The first voltage division means 102 of the reference voltage generation circuit 1309 has an intermediate-gradation voltage input terminal corresponding to any one of m levels of reference voltages VRi (such as VR0, VR8, . . . VR56, and VR63). It is assumed that the first embodiment has four intermediate-gradation-voltage input terminals VR0, VR8, VR32, and VR63. A voltage may not be applied to intermediate-gradation-voltage input terminals other than VR0 and VR63.

In the case of the first voltage division means 102, the output terminal of a voltage follower circuit 101 connecting with an intermediate-gradation-voltage input terminal corresponding to the reference voltage VR63 is connected to the upper end of the resistance R63. An end corresponding to the switch SWE7 is connected to the lower end of the resistance R57, that is, the connective points between the resistances R57 and R56. Subsequently, one ends corresponding to switches SWE6, SWE5, . . . , and SWEL are connected to connective points between adjacent resistances R49 and R48, R41 and R40, . . . , and R09 and R08. Moreover, the output terminal of a voltage follower 100 connecting with an intermediate-gradation-voltage input terminal corresponding to the reference voltage VR0 is connected to the lower end of the resistance R01.

Furthermore, the resistance ratio between the dividing resistors R01 to R63 is set to a ratio capable of realizing the y-correction for displaying natural gradations by considering the difference between the light transmittance characteristic of the liquid-crystal material of an actual liquid-crystal display and the visual characteristic of a person. That is, the resistance ratio between the dividing resistors R01 and R63 is set so that a gradation display voltage has the polygonal-line characteristic shown in FIG. 7 in accordance with gradation display data. Therefore, the resistance ratio between the dividing resistors R01 and R63 of the first voltage division means 102 is obtained by not equally dividing the resistances R01 to R63 but unequally dividing them.

Figure 7:
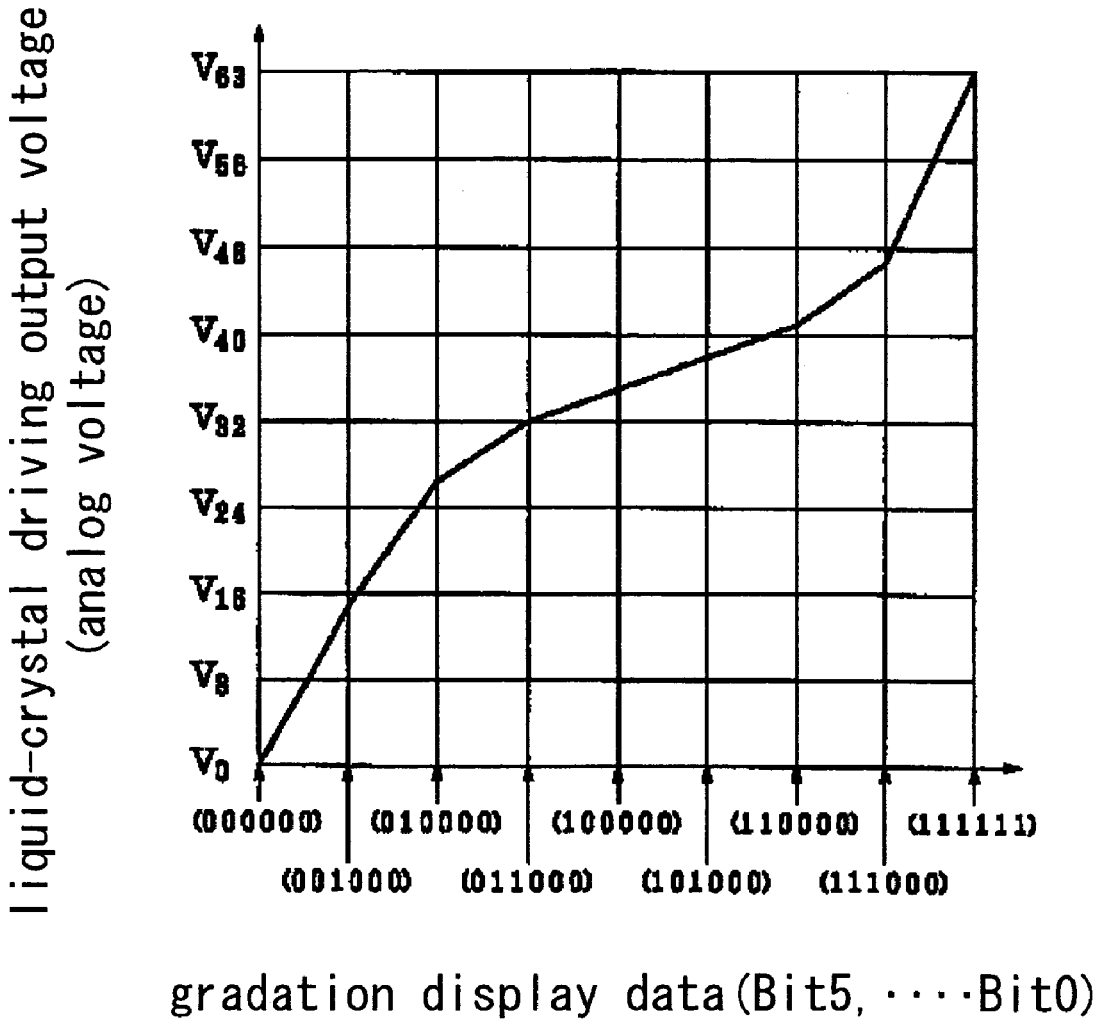
FIG. 7 is a y-correction characteristic diagram showing a relation between gradation display data values and liquid-crystal driving outputs by a polygonal line when performing y-correction.

Then, in the case of the second voltage division means 103, values of the auxiliary resistances R1 to R8 are also set so as to follow the y-correction shown in FIG. 7. Particularly, voltages corresponding to connection points between the auxiliary resistors R1 and R8 are decided so as to correspond to the polygonal line portion of the y-correction characteristic in FIG. 7.

In the case of the first embodiment, for example, the auxiliary resistor R8 is set correspondingly between the voltages V63 and V56 generated by the first voltage division means 102 and moreover, the auxiliary resistor R7 is set correspondingly between the voltages V56 and V48 generated by the first voltage division means 102. Subsequently, connection points between adjacent auxiliary resistors R6, R5, R4, . . . , and R2 are set correspondingly between the voltages V48 and V40, between the voltages V40 and V32, between the voltages V32 and V24, . . . , and between the voltages V16 and V8. Moreover, the resistance R1 is set correspondingly between the voltages V8 and V0. Moreover, the upper end of the auxiliary resistor R8 connects with the output terminal of the voltage follower circuit 101 connected to the intermediate-gradation-voltage input terminal of the reference voltage VR63 through the switch SWE8. However, the lower end of the auxiliary resistor R1 connects with the output terminal of the voltage follower circuit 100 connected to the intermediate-gradation-voltage input terminal of the reference voltage VR0 through the switch SWE0.

The voltage follower circuits 100 and 101 respectively constituted by a voltage-follower differential amplifying circuit are inserted in order to decrease the steady currents circulating between the dividing resistors R01 and R63 and between the auxiliary resistors R1 and R8 in impedance and output the currents.

As described above, the present invention is constituted so as to operate by using two circuits such as the y resistance division circuit (first voltage division means 102) having a high resistance value and the y resistance division circuit (second voltage division means 103) having a low resistance value, directly using the first voltage division means 102 under the steady state, closing (turning on) the switching means SWE0 to SWE8 in accordance with the control signal M (See FIG. 5) separately sent from the controller immediately after the latch signal LS is changed under the transient state in which the DA conversion circuit 1306 responds, and using the combined resistance value of the resistance of the second voltage division means 103 having a low resistance value and the resistance of the first voltage division means 102 having a high resistance value.

As shown in FIG. 5, when, for example, the output circuit 1307 constituted by a voltage follower circuit is used (corresponding to large screen panel), a gradation display voltage to be output to the electrode of the liquid-crystal panel is decreased in impedance by the output circuit 1307. Therefore, the above transient state corresponds to a period necessary to charge or discharge the stray capacitor of a switching circuit in the DA conversion circuit 1306 and the input capacitor of the output circuit 1307 when the switching circuit in the DA conversion circuit 1306 is switched synchronously with the latch signal LS corresponding to a horizontal sync signal. The second voltage division means 103 having a low resistance value is connected (SWE0 to SWE8 are turned on) to output terminals of the voltage follower circuits 100 and 101 at the initial period of input of the latch signal LS corresponding to the above time of charging or discharging the capacitors and returned to the conformation of connecting only the first voltage division means 102 having a high resistance value to output terminals of the voltage follower circuits 100 and 101 when the influence of charging or discharging disappears. The above mentioned is repeated every latch signal LS input corresponding to each horizontal sync period.

Moreover, as another embodiment, when the output circuit 1307 constituted by a voltage follower circuit is not used, that is, when an output of the DA conversion circuit 1306 is directly output to the electrode of the liquid-crystal panel (because the voltage follower circuit is an analog circuit and thereby, a layout area is comparatively large and power consumption is large, the output circuit 1307 may not be used for display driving circuit such as a cellphone using a small liquid-crystal panel), the above transient state corresponds to a period necessary to charge or discharge the pixel capacitor of the liquid-crystal panel and the stray capacitor of the switching circuit in the DA conversion circuit 1306. The second voltage division means 103 having a low resistance value is connected to output terminals (SWE0 to SWE8 are turned on) of the voltage follower circuits 100 and 101 at the initial period of latch-signal LS input corresponding to the above charging or discharging period and returned to the conformation of connecting only the first voltage division means 102 having a high resistance to output terminals of the voltage follower circuits 100 and 101 when the influence of the above charging or discharging disappears (steady state). The above mentioned is repeated every latch-signal LS input corresponding to each horizontal sync period.

Figure 8:
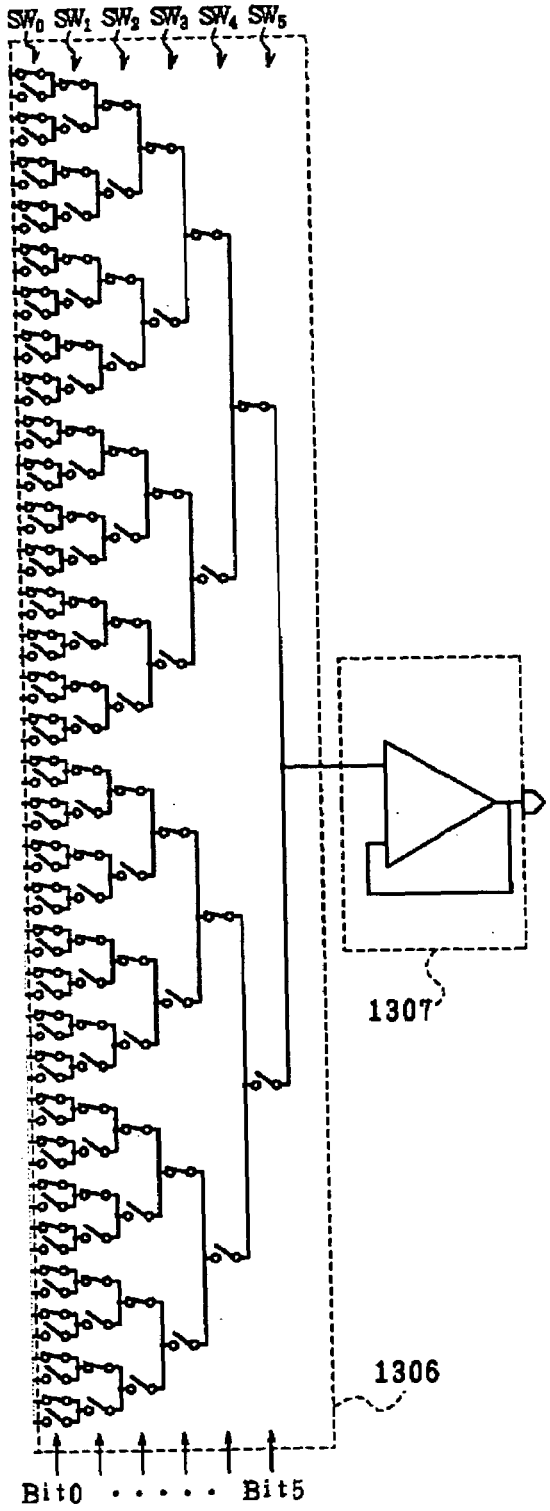
FIG. 8 is a circuit diagram showing a configuration of the DA conversion circuit used for the liquid-crystal driver of the present invention.

Then, the DA conversion circuit 1306 is described below. FIG. 8 shows a configuration of the DA conversion circuit 1306. As shown in FIG. 8, in the case of the DA conversion circuit 1306, MOS transistors and transmission gates are arranged as analog switches so that one of 64 levels of input analog voltages V0 to V63 is selected and output in accordance with the display data values constituted by 6-bit digital signals (bit 0 to bit 5). That is, correspondingly to each of the display data values constituted by 6-bit digital signals (bit 0 to bit 5), the half of the above switches SW0 to SW5 are turned on and the remaining half of the switches are turned off, one of 64 levels of the input analog voltages V0 to V63 is selected, and output to the output circuit 1307. The above state is described below. Switches corresponding to bit 0 to bit 5 are referred to as switches (group) SW0 to SW5 respectively.

In the case of a 6-bit digital signal, bit 0 is the LSB (minimum quantized bit) and bit 5 is the MSB (maximum quantized bit). The above switches SW0 to SW5 constitute a switch pair every two switches. Thirty-two switch pairs (64 switches SW0) correspond to bit 0 and sixteen switch pairs (32 switches SW1) correspond to bit 1. Subsequently, the number of switches is halved every bit and the switch pair (two switches SW5) corresponds to bit 5. Therefore, the total of $2^5+2^4+2^3+2^2+2^1+2^0=63$ switch pairs (126 switches) is present.

One ends of the switches SW0 corresponding to bit 0 serve as terminals to which analog voltages V0 to V63 are input. Moreover, the other ends of the switches SW0 are connected every two ends as a pair and furthermore, connected to one ends of the switches SW1 corresponding to the next bit 1. Subsequently, the above configuration is repeated up to the switch SW5 corresponding to bit 5. Finally, a wiring is led out from the switch SW5 corresponding to bit 5 and connected to the output circuit 1307.

Each of a group of the switches SW0 to SW5 is controlled as described below by 6-bit digitized data (bit 0 to bit 5).

In the case of the group of the switches SW0 to SW5, when a corresponding bit is set to 0 (low level), one of a pair of analog switches (lower switch in FIG. 8) is turned on but when a corresponding bit is set to 1 (high level), the other analog switch (upper switch in FIG. 8) is turned on. In FIG. 8, bit 0 to bit 5 are set to (111111) and in all switch pairs, upper switches are kept turned-on and lower switches are kept turned-off. In this case, the voltage V63 is output from the DA conversion circuit 1306 to the output circuit 1307.

Moreover, when bit 0 to bit 5 are set to (011111), the voltage V62 is output from the DA conversion circuit 1306 to the output circuit 1307, when bit 0 to bit 5 are set to (100000), the voltage V1 is output, and when bit 0 to bit 5 are set to (000000), the voltage V0 is output. Thus, one of the gradation-display analog voltages V0 to V63 is selected and gradation display is realized.

In the case of the above reference voltage generation circuit 1309, one circuit 1309 is normally set to one source driver IC and shared. However, the DA conversion circuit 1306 and output circuit 1307 are set correspondingly to each output terminal 1308.

Moreover, in the case of color display, the output terminal 1308 is used correspondingly to each color. Therefore, in this case, one DA conversion circuit 1306 and one output circuit 1307 are used every pixel and color. That is, when the number of pixels in the major-side direction of the liquid-crystal panel 901 is N and the output terminals 1308 for red, green, and blue are shown by adding a subscript n (n=1,2, . . . ,N) to R, G, and B, R1, G1, B1, R2, G2, B2, . . . , RN, GN, and BN are present as the output terminals 1308 and therefore, 3N DA conversion circuits 1306 and 3N output circuits 1307 are required.

Second Embodiment

Figure 9:
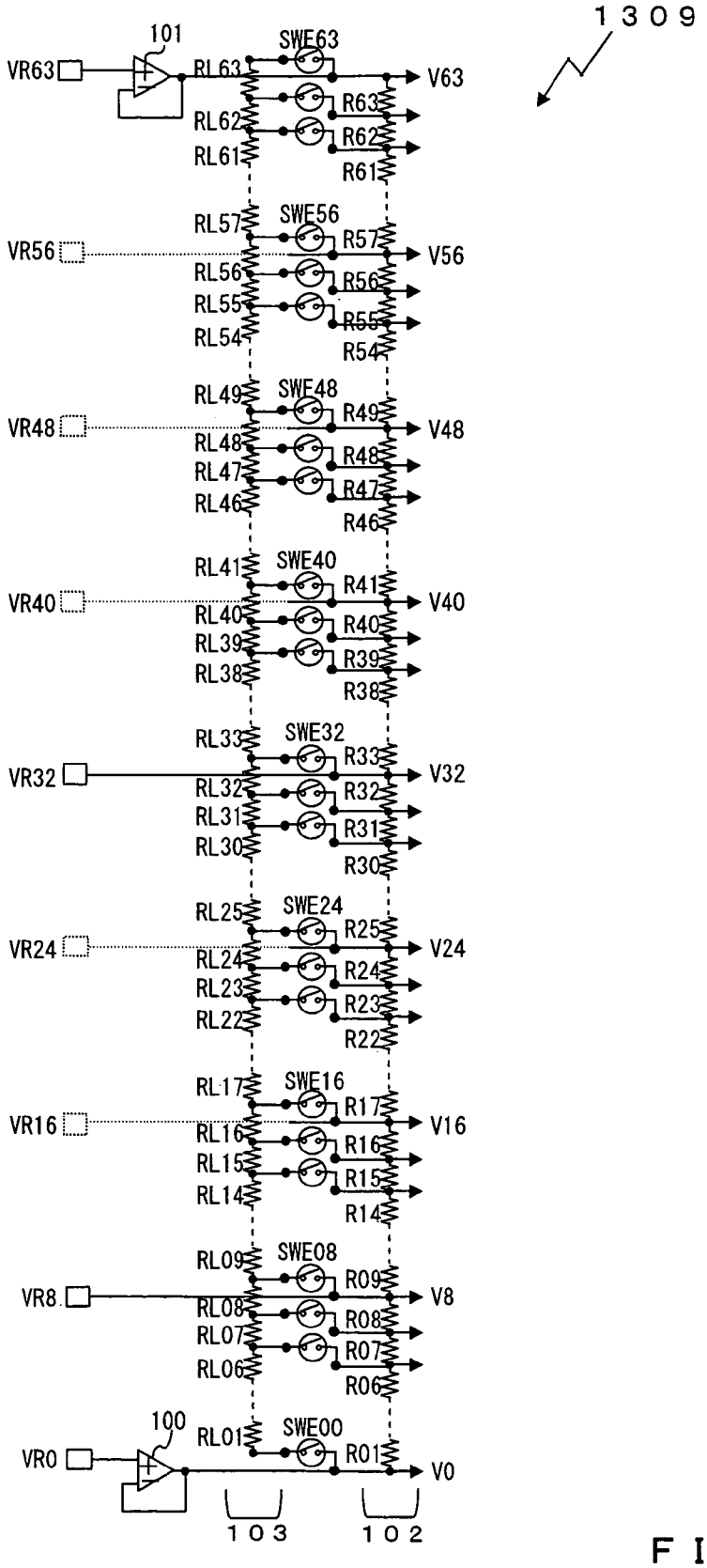
FIG. 9 is a circuit diagram showing a configuration of a reference voltage generation circuit of a second embodiment of the liquid-crystal driver of the present invention.

Then, the second embodiment of the present-invention device is described below. The second embodiment is different from the first embodiment in the circuit configuration of a reference voltage generation circuit 1309. Specifically, as shown in FIG. 9, though the basic configuration is the same as the case of the first embodiment, in which the reference voltage generation circuit 1309 has an intermediate-gradation-voltage input terminal, first voltage division means 102, second voltage division means 103, and switching means and 64 levels of analog voltages V0 to V63 corresponding to $2^6=64$ levels of gradation displays are output from m levels of reference voltages VRi (m values selected out of i=0–63, merely displayed as VR in FIG. 5), second voltage division means 103 and switching means are different from the case of the first embodiment. Because circuit portions other than the reference voltage generation circuit 1309 are the same as the case of the first embodiment, duplicate descriptions are omitted. Moreover, in FIG. 9, a circuit portion, circuit device, and signal same as those of the first embodiment are described by providing the same symbols for them.

As shown in FIG. 9, in the reference voltage generation circuit 1309, first voltage division means 102 is constituted by y dividing resistors R01 to R63 connected in series, the combined resistance value of the dividing resistors R01 to R63 is set comparatively high, and second voltage division means 103 is constituted by y dividing resistors (auxiliary resistors) RL01 to RL63 connected in series and the combined resistance value of the dividing resistors RL01 to RL63 is set comparatively low compared to the case of the first voltage division means 102. Moreover, switching means SWE0 to SWE63 are set which mutually connect corresponding contact points at the both ends of resistances of the first voltage division means 102 and second voltage division means 103. Thus, in the case of the reference voltage generation circuit 1309 of the second embodiment, when all the switching means SWE0 to SWE63 are turned on, it is possible to generate analog voltages V1 to V62 from connection points between the auxiliary resistors RL01 and RL63 of the second voltage division means 103 at a low impedance compared to the case of the first voltage division means 102.

The reference voltage generation circuit 1309 of the second embodiment is constituted so as to operate by directly using the first voltage division means 102 having a high resistance value under the steady state, turning on the switching means SWE0 to SWE63 in accordance with a control signal M separately sent from a controller only under a transient state in which the DA conversion circuit 1306 responds immediately after a change of the latch signal LS, and using the combined resistance value of the resistance value of the second voltage division means 103 having a low resistance value and that of the first voltage division means 102 having a high resistance value. The operation according to presence or absence of an output circuit 1307 constituted by a voltage follower circuit and the connection timing are the same as the case of the first embodiment.

Third Embodiment

Figure 10:
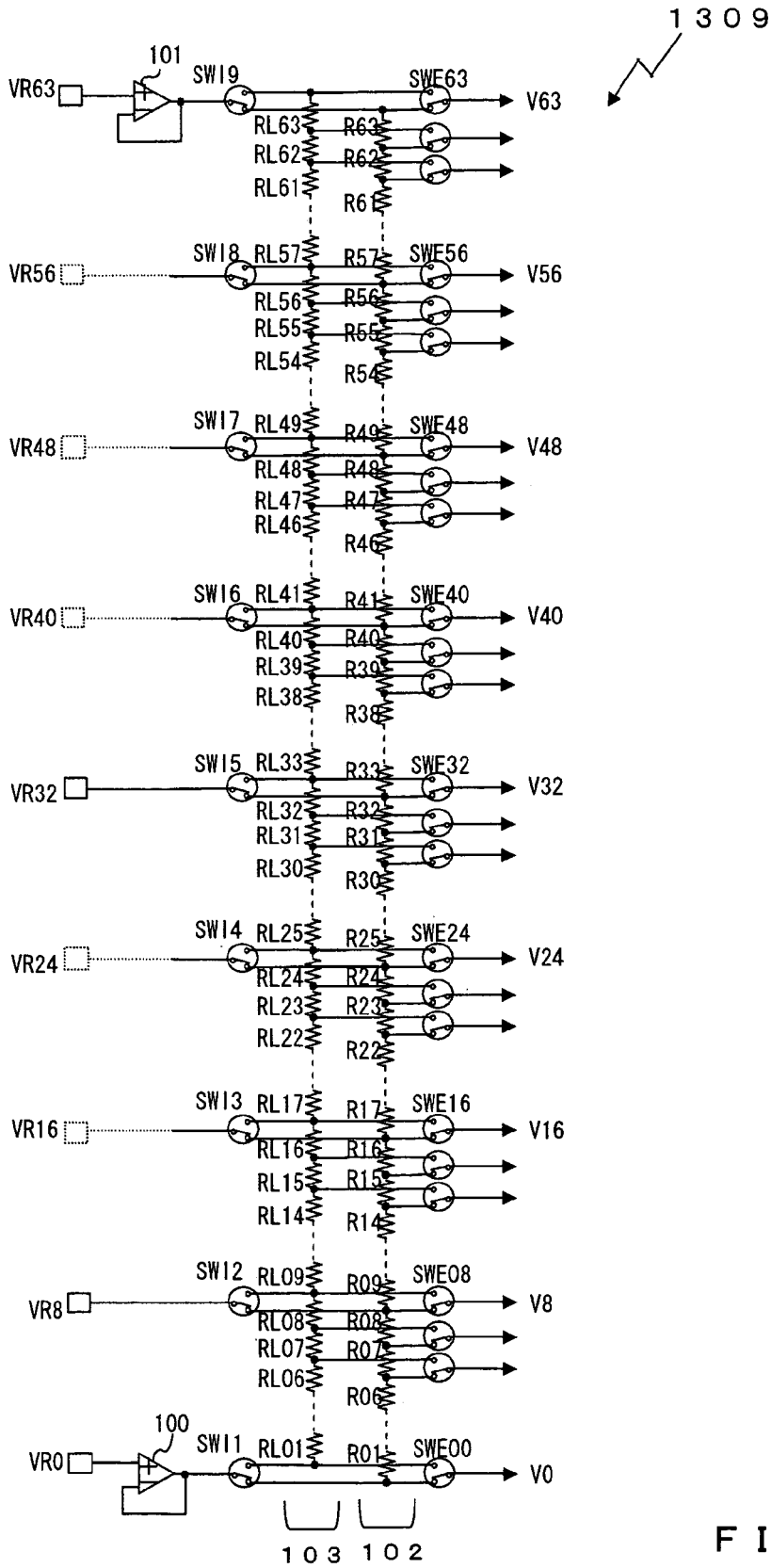
FIG. 10 is a circuit diagram showing a configuration of a reference voltage generation circuit of a third embodiment of the liquid-crystal driver of the present invention.
Figure 11:
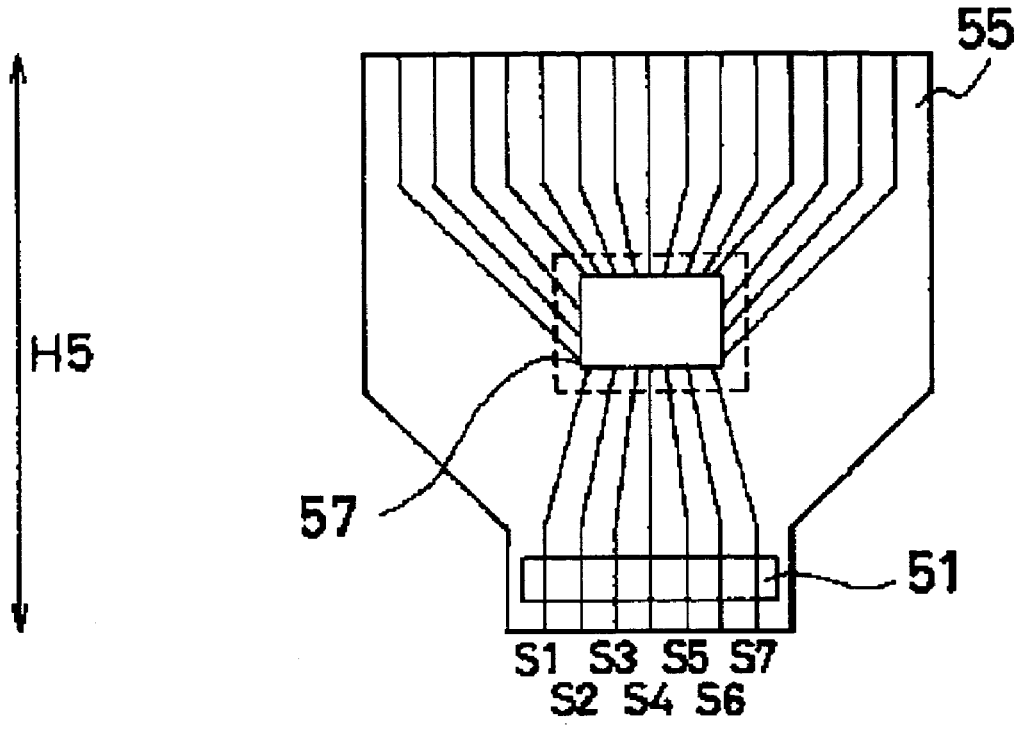
FIG. 11 PRIOR ART
FIG. 11 is an illustration showing a state in which a conventional liquid-crystal driver is mounted on the TCP.
Figure 12:
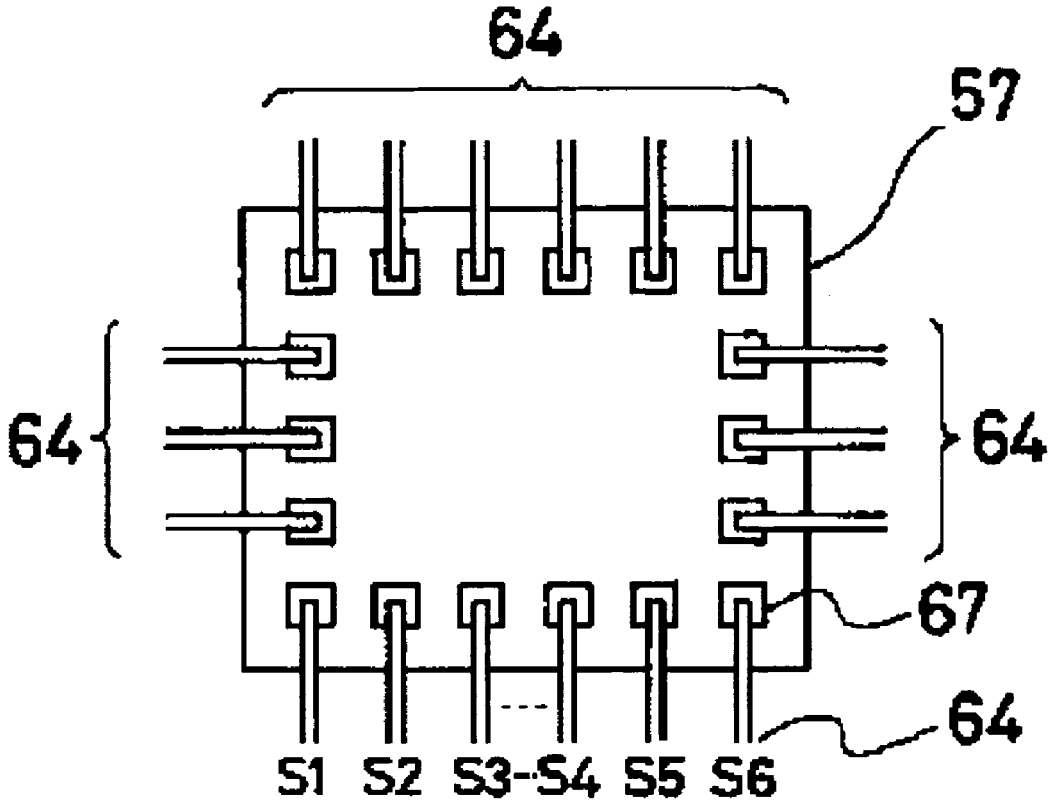
FIG. 12 PRIOR ART
FIG. 12 is an enlarged view of a connective portion between the liquid-crystal driver chip and the TCP when the conventional liquid-crystal driver shown in FIG. 11 is mounted on the TCP.
Figure 13:
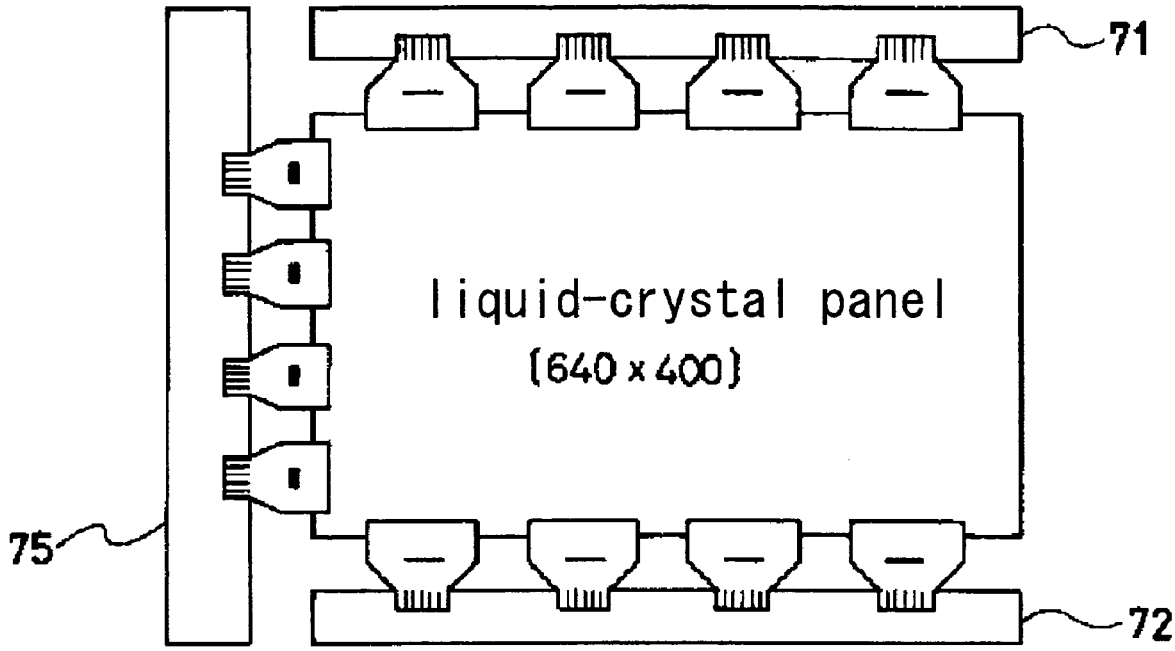
FIG. 13 PRIOR ART
FIG. 13 is an illustration showing an embodiment of a conventional liquid-crystal module.
Figure 14:
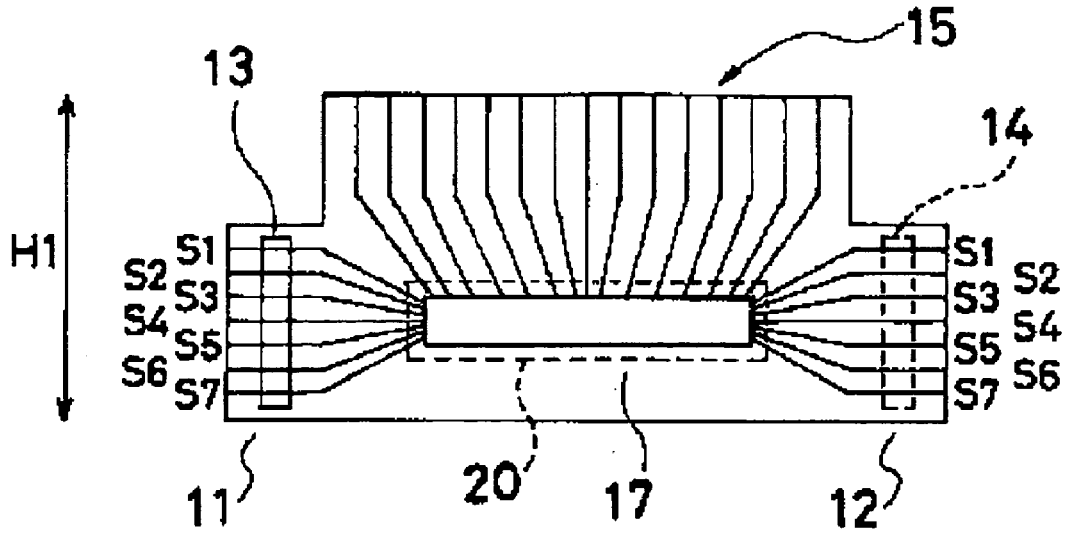
FIG. 14 PRIOR ART
FIG. 14 is an illustration showing another state in which the conventional liquid-crystal driver is mounted on the TCP.
Figure 15:
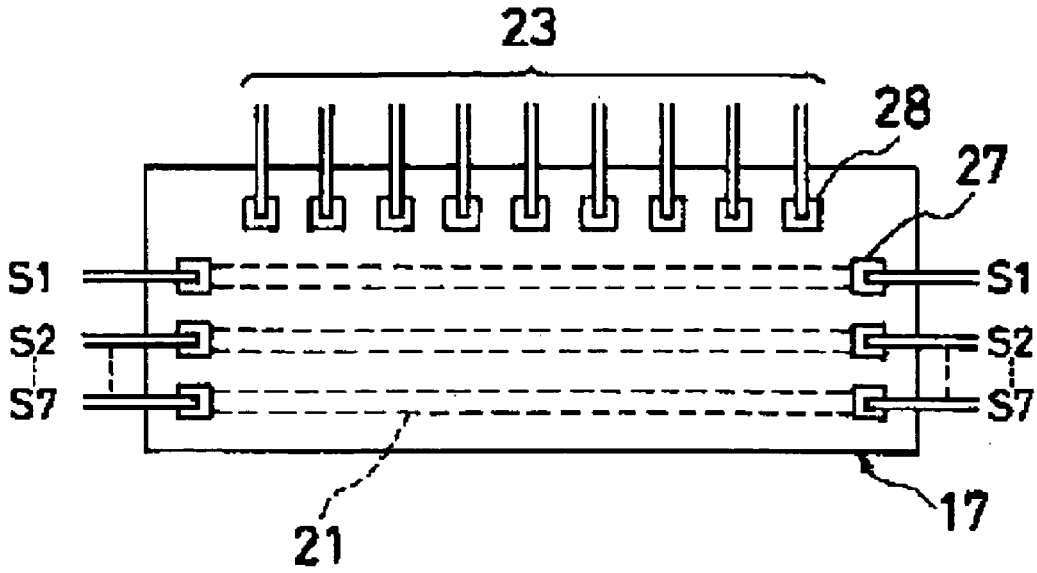
FIG. 15 PRIOR ART
FIG. 15 is an enlarged view of a connective portion between the liquid-crystal driver chip and the TCP when the conventional liquid-crystal driver shown in FIG. 14 is mounted on the TCP.
Figure 16:
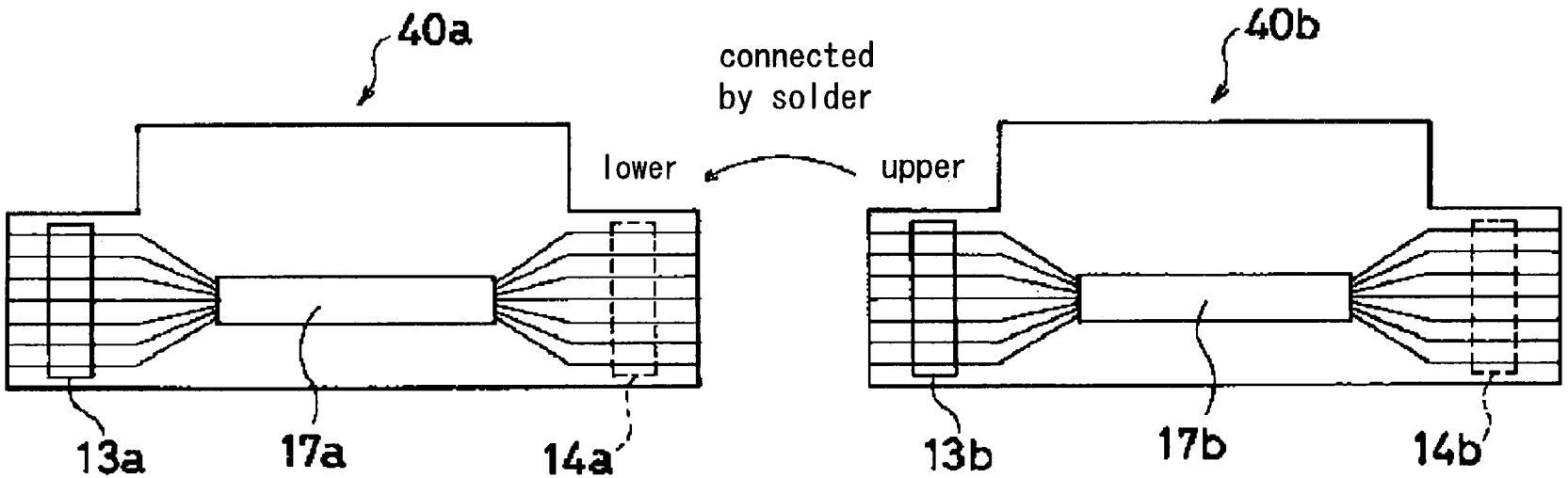
FIG. 16 PRIOR ART
FIG. 16 is an illustration showing a specific connection procedure between ICs of the liquid-crystal driver.
Figure 17:
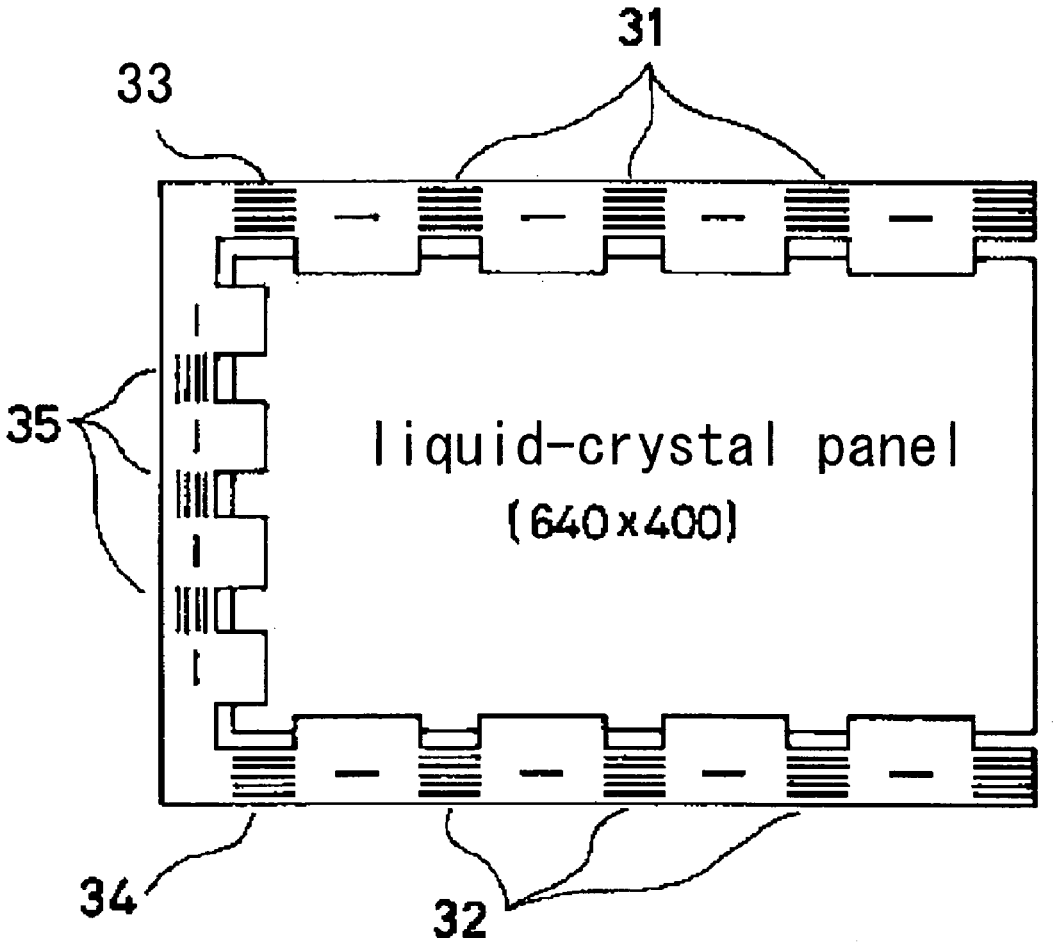
FIG. 17 PRIOR ART
FIG. 17 is an illustration showing another embodiment of the conventional liquid-crystal module.
Figure 18:
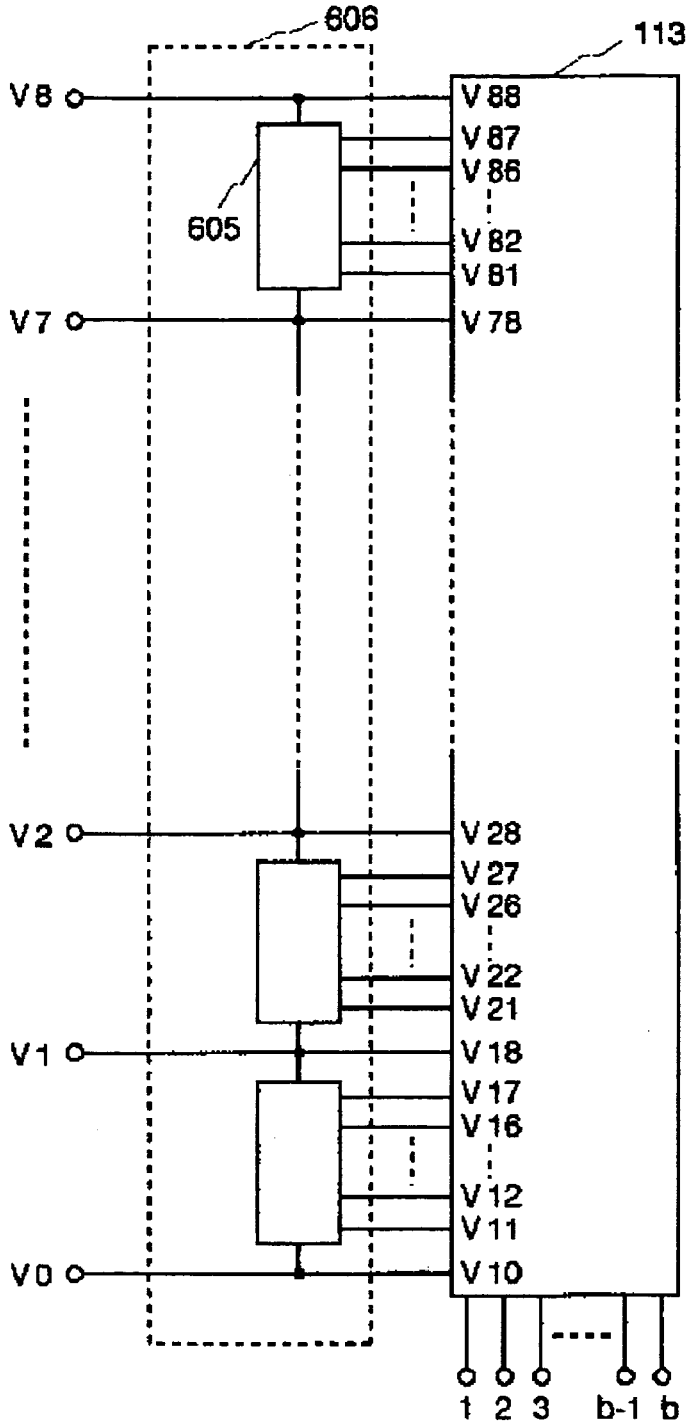
FIG. 18 PRIOR ART
FIG. 18 is a circuit diagram showing a schematic configuration of a gradation voltage generation circuit of a drain driving circuit of a conventional liquid-crystal display.
Figure 19:
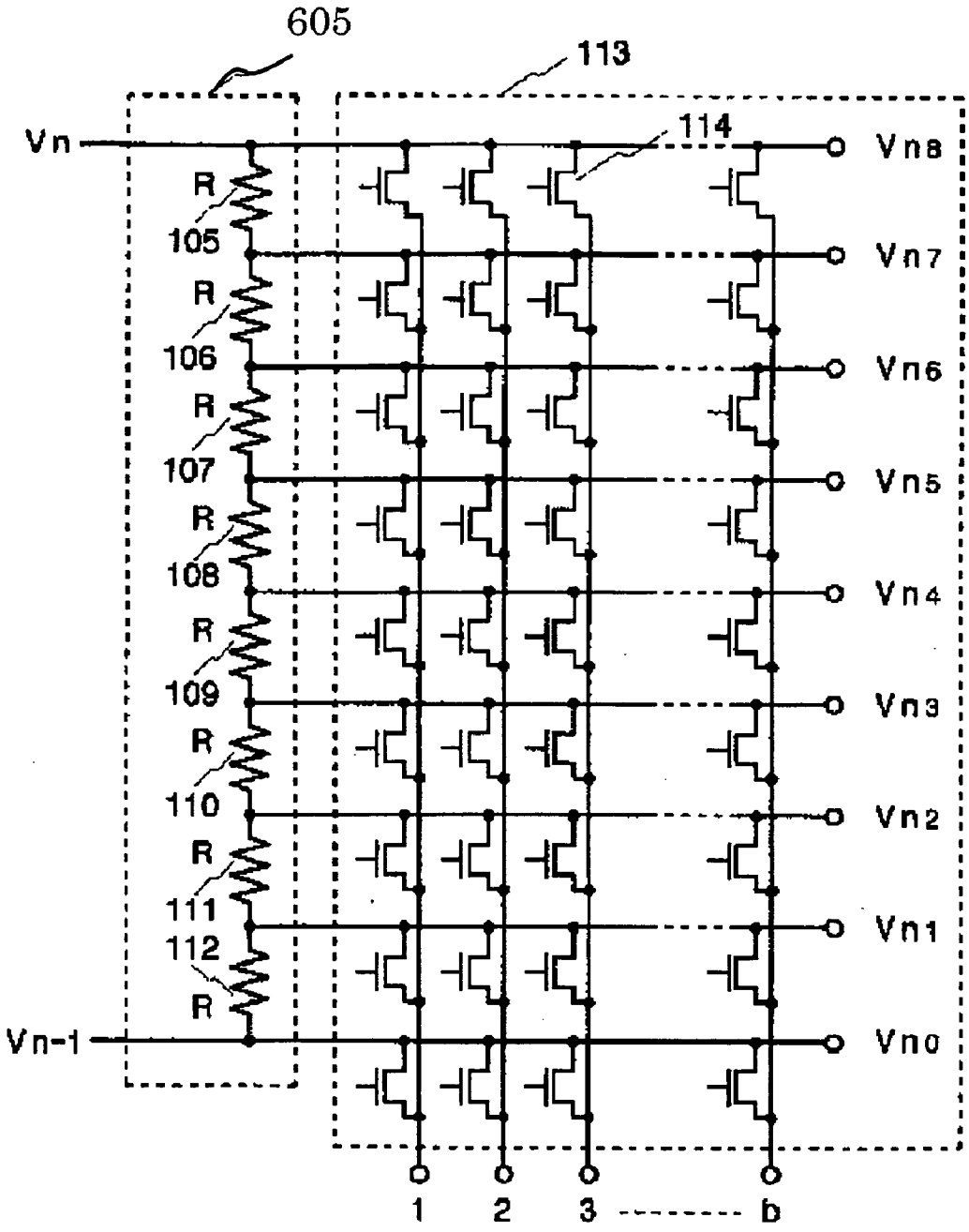
FIG. 19 PRIOR ART
FIG. 19 is a circuit diagram showing a schematic configuration for one-gradation reference voltage constituted by a gradation reference voltage Vn and a gradation reference voltage Vn−1 (n=1−8) in the gradation voltage generation circuit 606 shown in FIG. 18.

Then, the third embodiment of the present invention is described below. A circuit configuration of a reference voltage generation circuit 1309 is different from the case of the first and second embodiments. Specifically, as shown in FIG. 10, the basic configuration is the same as those of the first and second embodiments, in which the reference voltage generation circuit 1309 has an intermediate-gradation-voltage input terminal, first voltage division means 102, second voltage division means 103, and switching means and 64 levels of analog voltages V0 to V63 corresponding to $2^6$=64 levels of gradation displays are output from m levels of reference voltages VRi (m values selected out of i=0–63, merely displayed as VR in FIG. 5). However, the third embodiment is different from the first embodiment in configurations of the second voltage division means 103 and switching means and different from the second embodiment in the configuration of the switching means. Because circuit portions other than the reference voltage generation circuit 1309 are the same as those of the first and second embodiment, duplicate descriptions are omitted. Moreover, in FIG. 10, a circuit portion, circuit device, and signal same as those of the first and second embodiments are described by providing the same symbols for them.

As shown in FIG. 10, in the reference voltage generation circuit 1309, the first voltage division means 102 is constituted by y dividing resistors R01 to R63 connected in series, the combined resistance value of the dividing resistances R01 to R63 is set comparatively high, the second voltage division means 103 is constituted by y dividing resistors (auxiliary resistors) RL01 to RL63 connected in series, and the combined resistance value of the dividing resistances RL01 to RL63 is set comparatively low compared with that of the first voltage division means 102. Moreover, the switching means is constituted by m first switching means SWI1 to SWIm (in the case of the example shown in FIG. 10, SWI1 to SWI9) for connecting m levels of reference voltages VRi to either of the first voltage division means 102 and second voltage division means 103, and 64 second switching means SWE0 to SWE63 connected to fetch connecting 64 levels of analog voltages V0 to V63 from either of the first voltage division means 102 and second voltage division means 103. Thus, in the case of the reference voltage generation means 1309 of the third embodiment, the first switching means SWIL to SWIm and second switching means SWE0 to SWE63 are constituted not by on/off switches but by changeover switches for changing over two systems. Moreover, when the first switching means SWI1 to SWIm and second switching means SWE0 to SWE63 select the second voltage division means 103, it is possible to generate analog voltages V1 to V62 from connection points between the auxiliary resistors RL01 and RL63 at a low impedance compared to the case of the first voltage division means 102.

The reference voltage generation means 1309 of the third embodiment is constituted so that the first switching means SWI1 to SWIm and second switching means SWE0 to SWE63 select the first voltage division means 102 having a high resistance value under the steady state in accordance with the control signal M (See FIG. 5) separately sent from the controller, select the second voltage division means 103 having a low resistance value only under a transient state immediately after a change of the latch signal LS to which the DA conversion circuit 1306 responds, and the responsibility under the transient state is improved. The operation according to presence or absence of the output circuit 1307 constituted by a voltage follower circuit and the connection timing are the same as the case of the first embodiment.

Fourth Embodiment

Then, a fourth embodiment of the present invention is described below. In the case of the above first to third embodiments, the reference voltage generation circuit 1309 converts the reference voltages VR0 and VR63 into analog voltages V0 and V63 by lowering the voltages VR0 and VR63 in impedance by the voltage follower circuits 100 and 101. However, when the reference voltages VR0 and VR63 are already lowered in impedance or the output circuit 1307 constituted by a voltage follower circuit is used at the rear stage of the DA conversion circuit 1306, it is not always necessary to set the voltage follower circuits 100 and 101. Therefore, the reverence voltage generation circuit 1309 of the fourth embodiment has a conformation in which the voltage follower circuits 100 and 101 are eliminated from the reference voltage generation circuit 1309 used for the first to third embodiments and inputs and outputs of the circuits 100 and 101 are shorted. Operations of switching means are the same as the case of the first to third embodiments.

Then, another embodiment of the liquid-crystal display of the present invention having a present-invention device is described below. Each of the above first to fourth embodiments uses a configuration of sending and receiving input signals to and from each source driver 902 by constituting the liquid-crystal display only by the liquid-crystal panel and TCPs without using the printed wiring board described in "Description of the Related Art", connecting a signal line between adjacent TCPs, and using only wirings on the TCPs or also locally using wirings on a glass substrate as shown in FIG. 1. However, it is also allowed to constitute the liquid-crystal display by using the printed wiring board described in "Description of Related Art" for connection between driver ICs.

As described above in detail, it is possible to decrease power consumption and restrain brightness unevenness from occurring by constituting a present-invention device so as to operate in accordance with the combined resistance value of the resistance of second voltage division means having a low resistance value and the resistance of first voltage division means having a high resistance value or so as to operate only the second voltage division means having a low resistance value by using two voltage division means such as a y resistance division circuit (first voltage division means) having a high resistance value and y resistance division circuit (second voltage division means) having a low resistance, directly using the first voltage division means having a high resistance value under the steady state, operating switching means in accordance with a control signal separately sent from the controller immediately after a change of the latch signal LS under the transient state in which the DA conversion circuit responds.

Although the present invention has been described in terms of a preferred embodiment, it will be appreciated that various modifications and alternations might be made by those skilled in the art without departing from the spirit and scope of the invention. The invention should therefore be measured in terms of the claims which follow.

What is claimed is:

1. A liquid-crystal driver comprising:

reference voltage generation means for generating $2^n$ levels of gradation display voltages corresponding to n-bit display data in accordance with a plurality of input reference voltages; and a DA conversion circuit for selecting a gradation display voltage corresponding to the input display data out of the $2^n$ levels of gradation display voltages; wherein the liquid-crystal driver is constituted so as to be able to output the selected gradation display voltage to a liquid-crystal panel through a plurality of output terminals, the reference voltage generation means has first voltage division means constituted so as to be able to generate the $2^n$ levels of gradation display voltages by resistance-dividing voltage differences between the reference voltages by a plurality of dividing resistors connected in series, second voltage division means constituted so as to be able to generate the $2^n$ levels of gradation display voltages by resistance-dividing voltage differences between the reference voltages by a plurality of auxiliary resistors connected in series, and switching means for mutually connecting the $2^n$ levels of gradation display voltages generated by the first voltage division means and the $2^n$ levels of gradation display voltages generated by the second voltage division means, and the switching means is turned on during the transient state period in which the DA conversion circuit responds and the first and second voltage division means operate.

2. The liquid-crystal driver according to claim 1, wherein the combined resistance of the plurality of dividing resistors connected in series of the first voltage division means is larger than the combined resistance of the plurality of auxiliary resistors connected in series of the second voltage division means.

3. The liquid-crystal driver according to claim 1, wherein the reference voltage generation means outputs at least maximum and minimum voltages in the plurality of input reference voltages through a low-output-impedance voltage follower circuit.

4. The liquid-crystal driver according to claim 1, wherein the reference voltage generation means is built in a source driver.

5. The liquid-crystal driver according to claim 1, further comprising:

an output circuit which outputs the gradation display voltage selected by the DA conversion circuit to the liquid-crystal panel through a plurality of output terminals with lowering output impedance.

6. A liquid-crystal driver comprising:

reference voltage generation means for generating $2^n$ levels of gradation display voltages corresponding to n-bit display data in accordance with a plurality of input reference voltages; and a DA conversion circuit for selecting the gradation display voltage corresponding to the input display data out of the $2^n$ levels of gradation display voltages; wherein the liquid-crystal driver is constituted so as to be able to output the selected gradation display voltage to a liquid-crystal panel through a plurality of output terminals, the reference voltage generation means has first voltage division means constituted so as to be able to generate the $2^n$ levels of gradation display voltages by resistance-dividing voltage differences between the reference voltages by a plurality of dividing resistors connected in series, second voltage division means constituted so as to be able to generate some of the $2^n$ levels of gradation display voltages by resistance-dividing voltage differences between the reference voltages by a plurality of auxiliary resistors connected in series, and switching means for mutually connecting a part of the $2^n$ levels of gradation display voltages generated by the first voltage division means and the corresponding part of the $2^n$ levels of gradation display voltages generated by the second voltage division means, and the switching means is turned on during the transient state period in which the DA conversion circuit responds and the first and second voltage division means operate.

7. The liquid-crystal driver according to claim 6, wherein each value of the auxiliary resistors is set so that the corresponding part of the $2^n$ levels of gradation display voltages generated by the second voltage division means correspond to the polygonal line portion of the y-correction characteristic approximated to the polygonal line.

8. The liquid-crystal driver according to claim 6, wherein the combined resistance of the plurality of dividing resistors connected in series of the first voltage division means is larger than the combined resistance of the plurality of auxiliary resistors connected in series of the second voltage division means.

9. The liquid-crystal driver according to claim 6, wherein the reference voltage generation means outputs at least the maximum and minimum voltages of the plurality of input reference voltages through a low-output-impedance voltage follower circuit.

10. The liquid-crystal driver according to claim 6, wherein the reference voltage generation means is built in a source driver.

11. The liquid-crystal driver according to claim 6, further comprising:

an output circuit which outputs the gradation display voltage selected by the DA conversion circuit to the liquid-crystal panel through a plurality of output terminals with lowering output impedance.

12. A liquid-crystal driver comprising:

reference voltage generation means for generating $2^n$ levels of gradation display voltages corresponding to n-bit display data in accordance with a plurality of input reference voltages; and a DA conversion circuit for selecting the gradation display voltage corresponding to the input display data out of the $2^n$ levels of gradation display voltages; wherein the liquid-crystal driver is constituted so as to be able to output the selected gradation display voltage to a liquid-crystal panel through a plurality of output terminals, the reference voltage generation means has first voltage division means constituted so as to be able to generate the $2^n$ levels of gradation display voltages by resistance-dividing voltage differences between the reference voltages by a plurality of dividing resistors connected in series, second voltage division means constituted so as to be able to generate the $2^n$ levels of gradation display voltages by resistance-dividing voltage differences between the reference voltages by a plurality of auxiliary resistors connected in series, and switching means for selecting either of the $2^n$ levels of gradation display voltages generated by the first voltage division means and the $2^n$ levels of gradation display voltages generated by the second voltage division means and outputting selected ones, wherein the combined resistance of the plurality of dividing resistors connected in series of the first voltage division means is set to a value larger than the combined resistance of the plurality of auxiliary resistors connected in series of the second voltage division means, and the switching means selects the second voltage division means during the transient state period in which the DA conversion circuit responds and selects the first voltage division means under the steady state.

13. The liquid-crystal driver according to claim 12, wherein the reference voltage generation means outputs at least the maximum and minimum voltages of the plurality of input reference voltages through a low-output-impedance voltage follower circuit.

14. The liquid-crystal driver according to claim 12, wherein the reference voltage generation means is built in the source driver.

15. The liquid-crystal driver according to claim 12, further comprising:

an output circuit which outputs the gradation display voltage selected by the DA conversion circuit to the liquid-crystal panel through a plurality of output terminals with lowering output impedance.

16. A liquid-crystal display comprising:

the liquid-crystal driver of claim 1.

17. A liquid-crystal display comprising:

the liquid-crystal driver of claim 6.

18. A liquid-crystal display comprising:

the liquid-crystal driver of claim 12.

* * * * *